United States Patent [19]

Aoki

[11] Patent Number: 4,630,318

[45] Date of Patent: Dec. 23, 1986

[54] BASEBALL CATCHING MEANS

[75] Inventor: Akio Aoki, Hirakata, Japan

[73] Assignee: Trion Corporation, Japan

[21] Appl. No.: 692,833

[22] Filed: Jan. 18, 1985

[51] Int. Cl.[4] ..... A41D 13/10

[52] U.S. Cl. ..... 2/19; 2/161 R

[58] Field of Search ..... 2/19, 20, 16, 161 R, 2/161 A

[56] References Cited

U.S. PATENT DOCUMENTS

| | | | |
|---|---|---|---|
| 980,679 | 1/1911 | Rogers | 2/19 |
| 1,421,308 | 6/1922 | Raymond | 2/19 |
| 1,465,830 | 8/1923 | Raymond | 2/19 |
| 3,300,787 | 1/1967 | Denkert | 2/19 |
| 4,121,824 | 10/1978 | Hirschfield | 2/19 X |

*Primary Examiner*—Werner H. Schroeder
*Assistant Examiner*—Judith L. Olds
*Attorney, Agent, or Firm*—Jones, Tullar & Cooper

[57] ABSTRACT

A baseball catching means comprises a front ply defining a ball receiving area and a lining ply disposed over a back face of the front ply. The lining ply is provided with a padding material attached to a back face thereof.

2 Claims, 2 Drawing Figures

BASEBALL CATCHING MEANS

BACKGROUND OF THE INVENTION

This invention relates to ball catching means including varied types of glove and mitt for use in baseball games.

Generally, a baseball glove has a ball receiving side formed by a front ply defining a ball receiving surface and a lining ply disposed over a back face of the front ply and coming into contact with a player's hand. In order to ease a ball impact, a felt material usually is applied to the front ply or the lining ply except a portion thereof defining a pocket (or a palm portion). A heel portion of the glove contains a thick absorbing material. On the other hand, the portion of the glove extending from the pocket to finger pieces is provided with only a thin felt material to facilitate ball catching movements.

It is, however, crotch portions of first-finger and second-finger pieces including no thick shock absorbing material that undergo the strongest ball impact. Therefore, according to recent practice, a hole is defined in a back portion of the first-finger piece to permit the player to keep his first finger out of the glove to ease the ball impact. However, such a modification is inadequate to ease the ball impact and has a disadvantage of slackening the ball catching movement of the first finger.

An improved construction has been devised wherein a shock absorbing material is inserted between the front ply and the lining ply at the pocket portion of the glove. Normally the pocket portion contains grease between the front ply and the lining ply, and it has been found that the shock absorbing material and the grease tend to mix together and as a result the shock abosrbing material deteriorates in its function.

SUMMARY OF THE INVENTION

It is the object of this invention to provide a baseball catching means which overcomes the disadvantage of the prior art as noted above and produces an excellent shock absorbing effect.

In order to achieve the above object, a baseball catching means according to this invention comprises a front ply defining a ball catching area, a back ply defining a back side of the ball catching means, a lining ply disposed over a back face of the front ply and defining a back face, and padding means attached to the back face of the lining ply.

Since the above padding means is disposed on the back face of the lining ply, namely the ply that contacts a player's hand, the padding means produces a sufficient shock absorbing effect in contrast with the case of the padding disposed between the front ply and the lining ply, which is prone to mixing with the grease to deteriorate its shock absorbing effect. Furthermore, since the padding means is attached to the back face of the lining ply, the padding means may be attached to any desired part of the back face in addition to the part corresponding to the first-finger piece. The construction according to this invention also has an advantage that the padding means may be attached without changing designs of the front and other plies and without changing a glove stitching process.

Other advantages of this invention will be appararent from the following description.

BRIEF DESCRIPTION OF THE DRAWINGS

The drawings show a baseball catching means embodying this invention, in which.

DESCRIPTION OF THE PREFERRED EMBODIMENT

Figure 2:
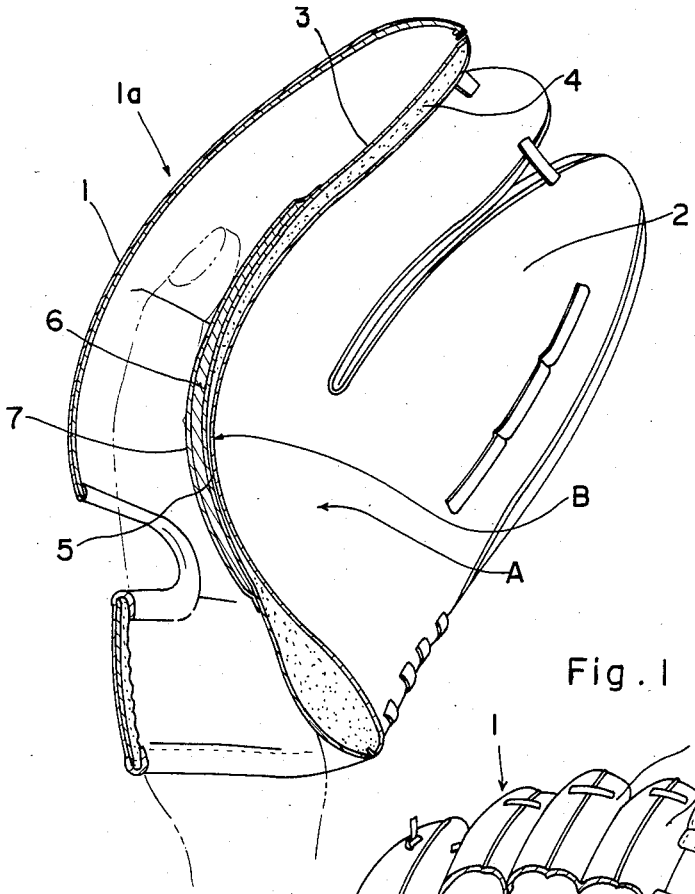
FIG. 2 is a side view in vertical section of the glove.
Figure 1:
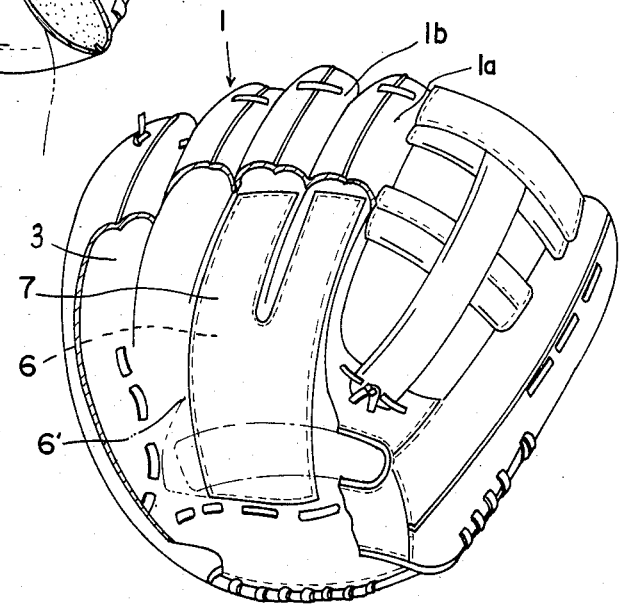
FIG. 1 is a partly broken away perspective view of a baseball glove.

Referring to FIG. 1, a baseball glove comprises a back ply 1 defining back sides of a plurality of thumb and finger pieces. As shown in FIG. 2, the glove further comprises a front ply 2 defining a ball receiving area A and front sides of the thumb and finger pieces. The front ply 2 is backed by a lining ply 3 formed of a softer leather material than the back and front plies 1, 2. A shock absorbing felt material 4 is provided between the front ply 2 and the lining ply 3, which felt material 4 lies in the ball receiving area A except a pocket B, namely except a palm portion and crotch portions of a first-finger piece 1*a* and a second-finger piece 1*b*. The front ply 2 and the lining ply 3 contain grease 5 in a position therebetween corresponding to the pocket B. Number 6 denotes a padding stitched by means of a retainer member 7 to a back face of the lining ply 3 and extending from intermediate positions inside the first-finger piece 1*a* and the second-finger piece 1*b* to a portion corresponding to the pocket B. While in this embodiment the padding 6 comprises urethane, the padding 6 may comprise any other material that has a shock absorbing property.

The padding may have a double layer structure, with an additional layer shown by a phantom line 6' in FIG. 1. In this instance the additional padding layer 6' extends over a portion undergoing strong ball receiving impacts, other portions being provided with a single layer of the padding 6 only. Depending on the type glove, the single layer of the padding 6 may have a varying thickness instead of providing the additional layer 6'. The padding, with or without the additional layer 6', may extend over a larger area than in the described embodiment. Furthermore, the padding 6 may be attached to the lining ply by using an adhesive instead of stitching.

What is claimed is:

1. A baseball catching means comprising:

a front ply defining a ball receiving area and a back face;

a back ply defining a back side of the baseball catching means;

a lining ply disposed over the back face of the front ply, said lining ply defining a back face;

padding means attached to the top the back face of the lining ply; and a retainer member for attaching the padding means to the lining ply.

2. The baseball catching means as defined in claim 1, wherein the front and back plies define a first finger piece and a second finger piece, and wherein the padding means is provided in at least a position adjacent crotch portions of the first and second finger pieces.

* * * * *